US006373454B1

(12) United States Patent
Knapp et al.

(10) Patent No.: US 6,373,454 B1
(45) Date of Patent: Apr. 16, 2002

(54) ACTIVE MATRIX ELECTROLUMINESCENT DISPLAY DEVICES

(75) Inventors: Alan G. Knapp, Crawley; Neil C. Bird, Horley, both of (GB)

(73) Assignee: U.S. Philips Corporation, New York, NY (US)

( * ) Notice: Subject to any disclaimer, the term of this patent is extended or adjusted under 35 U.S.C. 154(b) by 0 days.

(21) Appl. No.: 09/329,027

(22) Filed: Jun. 9, 1999

(30) Foreign Application Priority Data

Jun. 12, 1998 (GB) ..... 9812742

(51) Int. Cl.[7] ..... G09G 3/30

(52) U.S. Cl. ..... 345/76; 345/82; 345/205; 315/169.3

(58) Field of Search ..... 345/76, 82, 44–46, 345/55, 205–206; 313/483–498, 509; 315/169.1, 169.3, 169.4; 257/40

(56) References Cited

U.S. PATENT DOCUMENTS

| | | | | |
|---|---|---|---|---|
| 5,302,966 A | * | 4/1994 | Stewart | 345/76 |
| 5,652,600 A | * | 7/1997 | Khormaei et al. | 345/76 |
| 6,034,659 A | * | 3/2000 | Wald et al. | 345/76 |
| 6,091,203 A | * | 7/2000 | Kawashima et al. | 315/169.3 |
| 6,229,506 B1 | * | 5/2001 | Dawson et al. | 345/82 |

FOREIGN PATENT DOCUMENTS

| | | |
|---|---|---|
| EP | 0717446 A2 | 6/1996 |
| WO | 9636959 A2 | 11/1996 |

OTHER PUBLICATIONS

Hsu, J. et al. "100 MHz Active–Matrix Electroluminescent Displays", SID 98 Digest, vol. XXIX, pp. 949–952, May 1998.*

Rajeswaran, G. et al, "Active Matrix Low Temperature Poly–Si TFT/OLED Full Color Displays: Development Status" SID 2000 Digest, vol. XXXI pp 974–977, May 2000.*

"Visible Light Emission From Semiconducting Polymer Diodes'", by Braun et al, in Appl. Phys. Letter 58 (18), May 6, 1991, pp 19821984.

* cited by examiner

*Primary Examiner*—Richard Hjerpe
*Assistant Examiner*—Frances Nguyen
(74) *Attorney, Agent, or Firm*—Aaron Waxler

(57) ABSTRACT

An active matrix electroluminescent display device has an array of current-driven electroluminescent display elements (20), for example comprising organic electroluminescent material, whose operations are each controlled by an associated switching means (10) to which a drive signal for determining a desired light output is supplied in a respective address period and which is arranged to drive the display element according to the drive signal following the address period. Each switching means comprises a current mirror circuit (30, 32, 38) in which the same transistor (30) is used to both sense and produce the required drive current for the display element (20) with the gate of the transistor being connected to a storage capacitance (30) on which a voltage determined by the drive signal is stored. This allows variations in transistor characteristics over the array to be compensated and improved uniformity of light outputs from the display elements to be obtained.

9 Claims, 3 Drawing Sheets

ACTIVE MATRIX ELECTROLUMINESCENT DISPLAY DEVICES

BACKGROUND OF THE INVENTION

This invention relates to active matrix electroluminescent display devices comprising a matrix array of electroluminescent display elements each of which has an associated switching means for controlling the current through the display element, in accordance with an applied drive signal.

Matrix display devices employing electroluminescent, light-emitting, display elements are well known. As for the display elements organic thin film electroluminescent elements and light-emitting diodes (LEDs), comprising traditional III-V semiconductor compounds, have been used. In the main, such display devices have been of the passive type in which the electroluminescent display elements are connected between intersecting sets of row and column address lines and addressed in multiplexed fashion. Recent developments in (organic) polymer electroluminescent materials have demonstrated their ability to be used practically for video display purposes and the like. Electroluminescent elements using such materials typically comprise one or more layers of a semiconducting conjugated polymer sandwiched between a pair of (anode and cathode) electrodes, one of which is transparent and the other of which is of a material suitable for injecting holes or electrons into the polymer layer. An example of such is described in an article by D. Braun and A. J. Heeger in Applied Physics Letters 58 (18) p.p. 1982–1984 (May 6th 1991). By suitable choice of the conjugated polymer chain and side chains, it is possible to adjust the bandgap, electron affinity and the ionisation potential of the polymer. An active layer of such a material can be fabricated using a CVD process or simply by a spin-coating technique using a solution of a soluble conjugated polymer. Through these processes, LEDs and displays with large light-emitting surfaces can be produced.

Organic electroluminescent materials offer advantages in that they are very efficient and require relatively low (DC) drive voltages. Moreover, in contrast to conventional LCDs, no backlight is required. In a simple matrix display device, the material is provided between sets of row and column address conductors at their intersections thereby forming a row and column array of electroluminescent display elements. By virtue of the diode-like I-V characteristic of the organic electroluminescent display elements, each element is capable of providing both a display and a switching function enabling multiplexed drive operation. However, when driving this simple matrix arrangement on a conventional row at a time scanning basis each display element is driven to emit light for only a small fraction of the overall field time, corresponding to a row address period. In the case of an array having N rows for example, each display element can emit light for a period equal to f/N at most where f is the field period. In order then to obtain a desired mean brightness from the display, it is necessary that the peak brightness produced by each element must be at least N times the required mean brightness and the peak display element current will be at least N times the mean current. The resulting high peak currents cause problems, notably with the more rapid degradation of the display element lifetime and with voltage drops caused along the row address conductors.

One solution to these problems is to incorporate the display elements into an active matrix whereby each display element has an associated switch means which is operable to supply a drive current to the display element so as to maintain its light output for a significantly longer period than the row address period. Thus, for example, each display element circuit is loaded with an analogue (display data) drive signal once per field period in a respective row address period which drive signal is stored and is effective to maintain a required drive current through the display element for a field period until the row of display elements concerned is next addressed. This reduces the peak brightness and the peak current required by each display element by a factor of approximately N for a display with N rows. An example of such an active matrix addressed electroluminescent display device is described in EP-A-0717446. The conventional kind of active matrix circuitry used in LCDs cannot be used with electroluminescent display elements as such display elements need to continuously pass current in order to generate light whereas the LC display elements are capacitive and therefore take virtually no current and allow the drive signal voltage to be stored in the capacitance for the whole field period. In the aforementioned publication, each switch means comprises two TFTs (thin film transistors) and a storage capacitor. The anode of the display element is connected to the drain of the second TFT and the first TFT is connected to the gate of the second TFT which is connected also to one side of the capacitor. During a row address period, the first TFT is turned on by means of a row selection (gating) signal and a drive (data) signal is transferred via this TFT to the capacitor. After the removal of the selection signal the first TFT turns off and the voltage stored on the capacitor, constituting a gate voltage for the second TFT, is responsible for operation of the second TFT which is arranged to deliver electrical current to the display element. The gate of the first TFT is connected to a gate line (row conductor) common to all display elements in the same row and the source of the first TFT is connected to a source line (column conductor) common to all display elements in the same column. The drain and source electrodes of the second TFT are connected to the anode of the display element and a ground line which extends parallel to the source line and is common to all display elements in the same column. The other side of the capacitor is also connected to this ground line. The active matrix structure is fabricated on a suitable transparent, insulating, support, for example of glass, using thin film deposition and process technology similar to that used in the manufacture of AMLCDs.

With this arrangement, the drive current for the light-emitting diode display element is determined by a voltage applied to the gate of the second TFT. This current therefore depends strongly on the characteristics of that TFT. Variations in threshold voltage, mobility and dimensions of the TFT will produce unwanted variations in the display element current, and hence its light output. Such variations in the second TFTs associated with display elements over the area of the array, or between different arrays, due, for example, to manufacturing processes, lead to non-uniformity of light outputs from the display elements.

SUMMARY OF THE INVENTION

It is an object of the present invention to provide an improved active matrix electroluminescent display device.

It is another object of the present invention to provide a display element circuit for an active matrix electroluminescent display device which reduces the effect of variations in the transistor characteristics on the light output of the display elements and hence improves the uniformity of the display.

This objective is achieved in the present invention by using a current mirror circuit for the switching means in which the same transistor is used to both sense and later produce the required drive current for the display element. This allows all variations in transistor characteristics to be compensated.

According to the present invention, there is provided an active matrix electroluminescent display device of the kind described in the opening paragraph, in which the switching means comprises a drive transistor whose first current-carrying terminal is connected to a first supply line, whose second current-carrying terminal is connected via the display element to a second supply line and whose gate is connected to its first current-carrying terminal via a capacitance, which is characterized in that the second current-carrying terminal of the drive transistor is connected to an input terminal for the drive signal and in that a switch device is connected between the second current-carrying terminal and the gate of the transistor which is operable during the application of a drive signal so as to store on the capacitance a gate voltage determined by the drive signal.

The arrangement of the switching means is such that it operates effectively in the manner of a single transistor current mirror circuit wherein the same transistor performs current sampling and current output functions. When the switch device is closed the transistor is diode connected and the input drive signal determines a current flow through the transistor and a consequential gate voltage which is stored on the capacitance. After the switch device opens, the transistor acts as a current source for the display element with the gate voltage determining the current level through the display element, and hence its brightness, which level is thereafter maintained, according to the set value, for example until the display element is next addressed. Thus, in a first operating phase, in effect a display element addressing period, an input current is sampled and the transistor gate voltage set accordingly and in a subsequent output phase the transistor operates to draw a current through the display element corresponding to the sampled current. Because in this arrangement the same transistor is used both to sample the input current during the sampling phase and to generate the drive current for the display element during the output phase the display element current is not dependent on the threshold voltage, the mobility, or the exact geometry of the transistor. The aforementioned problems of non-uniformity of light outputs from the display elements over the array is thus overcome.

Preferably, the display elements are arranged in rows and columns, and the switch devices of the switching means for a row of display elements are connected to a respective, common, row address conductor via which a selection (scan) signal for operating the switch devices in that row is supplied, and each row address conductor is arranged to receive a selection signal in turn, whereby the rows of display elements are addressed one at a time in sequence. The drive signals (display data) for the display elements in a column are preferably supplied via a respective column address conductor common to the display elements in the column, there being a further switch device connected between the input terminal of the switching means of a display element and its associated column address conductor which is operable to transfer a drive signal on the column address conductor to the input terminal when the first-mentioned switch device is closed. To this end, the further switch device is preferably connected to the same row address conductor as the first-mentioned switch device and operable simultaneously with that switch device by the selection signal applied to the row address conductor. During the time when the display element is not being addressed, i.e. the output phase, this further switching device serves to isolate the input terminal from the column address conductor.

Preferably the first supply line is shared by all display elements in the same row or column. A respective supply line may be provided for each row or column of display elements. Alternatively, a supply line could effectively be shared by all the display elements in the array using, for example, lines extending in the column or row direction and connected together at their ends or by using lines extending in both the column and the row directions and connected together in the form of a grid. The approach selected will depend on the technological details for a given design and fabrication process.

For simplicity, a first supply line which is associated, and shared by, a row of display elements may comprise the row address conductor associated with a different, preferably adjacent, row of display elements via which a selection signal is applied to the switch devices of the switching means of that different row.

The switch devices preferably also comprise transistors and all transistors may conveniently be formed as TFTs on a substrate of glass or other insulating material together with the address conductors using standard thin film deposition and patterning processes as used in the field of active matrix display devices and other large area electronic devices. It is envisaged however, that, the active matrix circuitry of the device may be fabricated using IC technology with a semiconductor substrate.

In order to prevent current flow through the display element during the sampling phase another switch device may be connected between the second current-carrying terminal of the drive transistor and the display element which is operable to isolate the display element from the drive transistor during the sampling phase. This switch device may similarly comprise a switching transistor but of opposite conductivity type to the transistors constituting the other switching devices so that, with its gate connected to the same row address conductor, it operates in complementary fashion. Thus, this transistor may comprise a p-channel device while the first-mentioned and further transistors comprise n-channel devices. Of course, by reversing the polarity of the display element and the polarity of the waveform applied to the row address conductors, the above transistor types can be reversed.

The need for such a complementary-operating switch device can be avoided. In a preferred embodiment a pulse signal is arranged to be applied to the first supply line, and thus the first current-carrying electrode of the drive transistor, during the sampling phase which reverse biases the display element, thereby preventing current flow through the display element and ensuring that the drain current through the drive transistor corresponds to the input signal current and that the appropriate gate-source voltage is sampled on the capacitance. In the case of the first supply line comprising a row address conductor associated with an adjacent row of display elements, this pulse is provided separate to the selection signal on that row address conductor and coincident in time with the selection signal on the row address conductor associated with the display element concerned. The amplitude of the pulse required is less than that of the selection signal. Besides reducing the total number of transistors required, the avoidance of a switching transistor connected between the second current-carrying terminal of the driving transistor and the display element simplifies fabrication as the transistors then needed are all of the same polarity type.

BRIEF DESCRIPTION OF A DRAWING

Embodiments of active matrix electroluminescent display devices in accordance with the invention will now be described, by way of example, with reference to the accompanying drawings, in which.

The figures are merely schematic and have not been drawn to scale. The same reference numbers are used throughout the figures to denote the same or similar parts.

DESCRIPTION OF THE PREFERRED EMBODIMENTS

Figure 1:
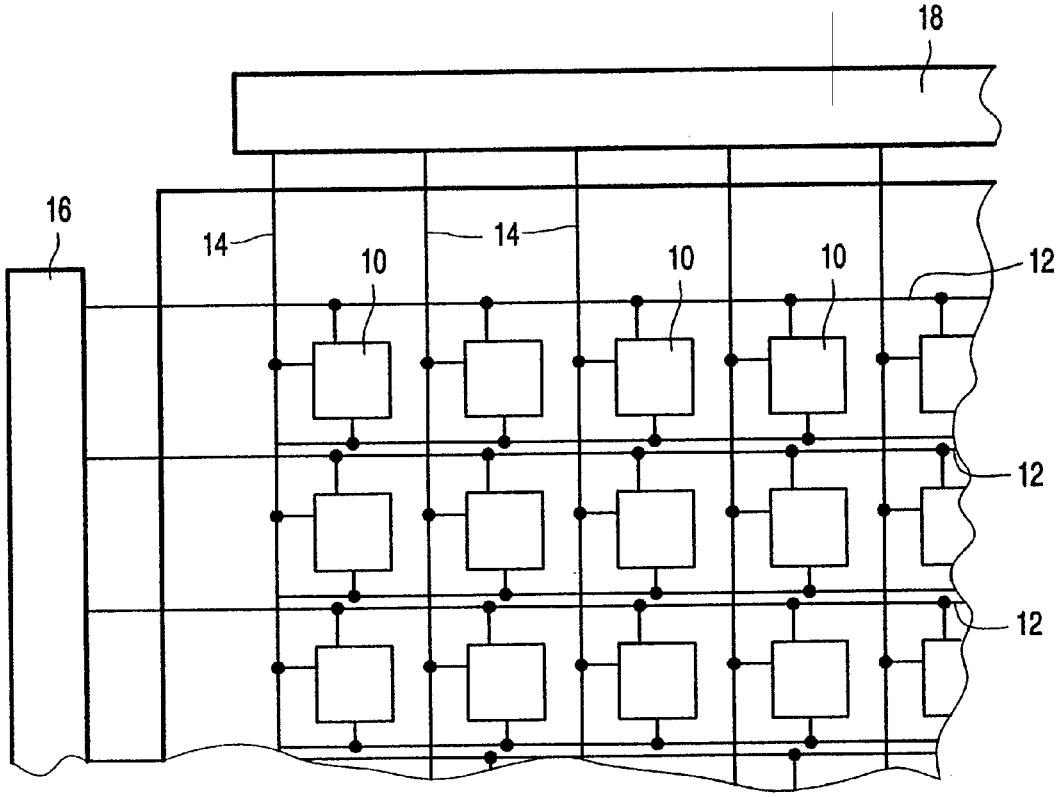
FIG. 1 is a simplified schematic diagram of part an embodiment of display device according to the invention.

Referring to FIG. 1, the active matrix addressed electroluminescent display device comprises a panel having a row and column matrix array of regularly-spaced pixels, denoted by the blocks 10 and comprising electroluminescent display elements together with associated switching means, located at the intersections between crossing sets of row (selection) and column (data) address conductors, or lines, 12 and 14. Only a few pixels are shown in the Figure for simplicity. In practice there may be several hundred rows and columns of pixels. The pixels 10 are addressed via the sets of row and column address conductors by a peripheral drive circuit comprising a row, scanning, driver circuit 16 and a column, data, driver circuit 18 connected to the ends of the respective sets of conductors.

Figure 2:
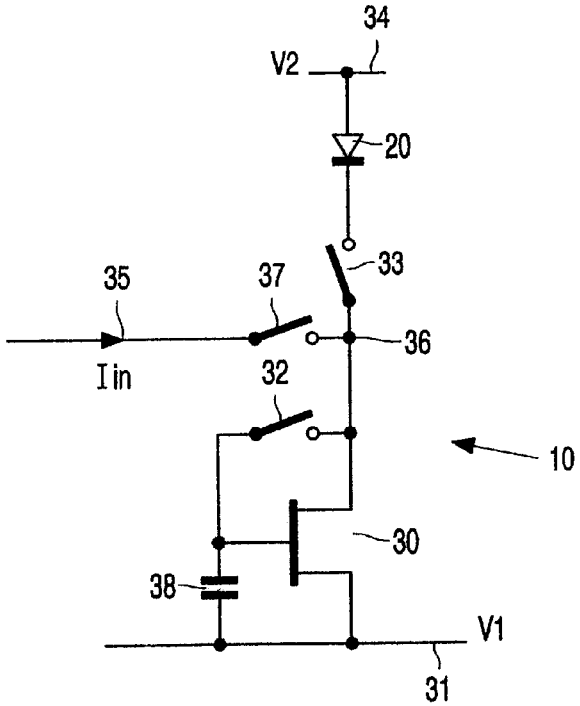
FIG. 2 shows in simple form the equivalent circuit of a typical pixel circuit comprising a display element and its associated control circuitry in the display device of FIG. 1.
Figure 3:
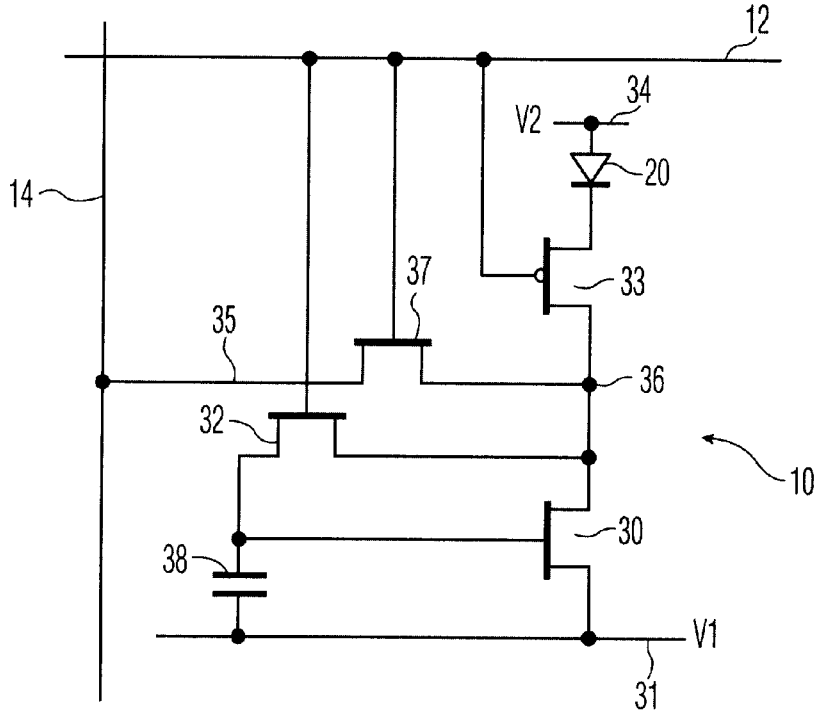
FIG. 3 illustrates a practical realization of the pixel circuit of FIG. 2.

FIG. 2 shows in simplified schematic form the circuit of a typical pixel block 10 in the array and is intended to illustrate the basic manner of its operation. A practical implementation of the pixel circuit of FIG. 2 is illustrated in FIG. 3. The electroluminescent display element, referenced at 20, comprises an organic light emitting diode, represented here as a diode element (LED) and comprising a pair of electrodes between which one or more active layers of organic electroluminescent material is sandwiched. The display elements of the array are carried together with the associated active matrix circuitry on one side of an insulating support. Either the cathodes or the anodes of the display elements are formed of transparent conductive material. The support is of transparent material such as glass and the electrodes of the display elements 20 closest to the substrate may consist of a transparent conductive material such as ITO so that light generated by the electroluminescent layer is transmitted through these electrodes and the support so as to be visible to a viewer at the other side of the support. In this particular embodiment, however, the light output is intended to be viewed from above the panel and the display element anodes comprise parts of a continuous ITO layer 22 connected to a potential source and constituting a second supply line common to all display elements in the array and held at a fixed reference potential. The cathodes of the display elements comprise a metal having a low work-function such as calcium or a magnesium:silver alloy. Typically, the thickness of the organic electroluminescent material layer is between 100 nm and 200 nm. Typical examples of suitable organic electroluminescent materials which can be used for the elements 20 are described in EP-A-0 717446 to which reference is invited for further information and whose disclosure in this respect is incorporated herein. Electroluminescent materials such as conjugated polymer materials described in W096/36959 can also be used.

Each display element 20 has an associated switch means which is connected to the row and column conductors 12 and 14 adjacent the display element and which is arranged to operate the display element in accordance with an applied analogue drive (data) signal level that determines the element's drive current, and hence light output (grey-scale). The display data signals are provided by the column driver circuit 18 which acts as a current source. A suitably processed video signal is supplied to this circuit which samples the video signal and applies a current constituting a data signal related to the video information to each of the column conductors in a manner appropriate to row at a time addressing of the array with the operations of the column driver circuit and the scanning row driver circuit being synchronized.

Referring to FIG. 2, the switch means comprises a drive transistor 30, more particularly a n-channel FET, whose first current-carrying (source) terminal is connected to a supply line 31 and whose second current-carrying (drain) terminal is connected, via a switch 33, to the cathode of the display element 20. The anode of the display element is connected to a second supply line 34, which in effect is constituted by the continuous electrode layer held at a fixed reference potential. The gate of the transistor 30 is connected to the supply line 31, and hence the source electrode, via a storage capacitance 38 which may be a separately formed capacitor or the intrinsic gate-source capacitance of the transistor. The gate of the transistor 30 is also connected via a switch 32 to its drain terminal.

The transistor circuit operates in the manner of a single transistor current mirror with the same transistor performing both current sampling and current output functions and with the display element 20 acting as the load. An input to this current mirror circuit is provided by an input line 35 which connects to a node 36 between the switches 32 and 33, constituting an input terminal, via a further switch 37 which controls the application of an input signal to the node.

Operation of the circuit takes place in two phases. In a first, sampling, phase, corresponding in time to an addressing period, an input signal for determining a required output from the display element is fed into the circuit and a consequential gate-source voltage on the transistor 30 is sampled and stored in the capacitance 38. In a subsequent, output, phase the transistor 30 operates to draw current through the display element 20 according to the level of the stored voltage so as to produce the required output from the display element, as determined by the input signal, which output is maintained for example until the display element is next addressed in a subsequent, new, sampling phase. During both phases it is assumed that the supply lines 31 and 34 are at appropriate, pre-set, potential levels, V1 and V2. The supply line 31 will normally be at ground potential (V1) and the supply line 34 will be at a positive potential (V2).

During the sampling phase, the switches 32 and 37 are closed, which diode-connects the transistor 30, and the switch 33 is open, which isolates the display element load. An input signal, corresponding to the required display element current and denoted here as Iin, is driven through the transistor 30 from an external source, e.g. the column driver circuit 18 in FIG. 1, via the input line 35, the closed switch 37 and the input terminal 36. Because the transistor 30 is diode-connected by virtue of the closed switch 32, the voltage across the capacitance 38 at the steady state condition will be the gate-source voltage that is required to drive a current lin through the channel of the transistor 30. Having allowed sufficient time for this current to stabilize, the sampling phase is terminated upon the opening of the switches 32 and 37 isolating the input terminal 36 from the input line 35 and isolating the capacitance 38 so that the gate-source voltage, determined in accordance with the input signal lin, is stored in the capacitance 38. The output phase then begins upon the closing of the switch 33 thus connecting the display element cathode to the drain of the transistor 30. The transistor 30 then operates as a current source and a current approximately equal to lin is drawn through the display element 20. The drive current for the display element may differ very slightly from the input current lin because of capacitive coupling due to charge injection effects when switch 32 turns off causing a change in the voltage on capacitance 38 and also because the transistor 30 may not act as a perfect current source as in practice it is likely to have a finite output resistance. Because, however, the same transistor is used to sample lin during the sampling phase and to generate the current during the output phase, the display element current is not dependent on the threshold voltage or the mobility of the transistor 30.

FIG. 3 shows a practical embodiment of the pixel circuit of FIG. 2 used in the display device of FIG. 1. In this, the switches 32, 33 and 37 are each constituted by transistors and these switching transistors, together with the drive transistor 30, are all formed as thin film field effect transistors, TFTs. The input line 35, and the corresponding input lines of all pixel circuits in the same column, are connected to a column address conductor 14 and through this to the column driver circuit 18. The gates of the transistors 32, 33 and 37, and likewise the gates of the corresponding transistors in pixel circuits in the same row, are all connected to the same row address conductor 12. The transistors 32 and 37 comprise n-channel devices and are turned on (closed) by means of a selection (scan) signal in the form of a voltage pulse applied to the row address conductor 12 by the row driver circuit 16. The transistor 33 is of opposite conductivity type, comprising a p-channel device, and operates in complementary fashion to the transistors 32 and 37 so that it turns off (opens) when the transistors 32 and 37 are closed in response to a selection signal on the conductor 12, and vice versa.

The supply line 31 extends as an electrode parallel to the row conductor 12 and is shared by all pixel circuits in the same row. The supply lines 31 of all rows can be connected together at their ends. The supply lines may instead extend in the column direction with each lines then being shared by the display elements in a respective column. Alternatively, supply lines may be provided extending in both the row and column directions and interconnected to form a grid structure.

The array is driven a row at a time in turn with a selection signal being applied to each row conductor 12 in sequence. The duration of the selection signal determines a row address period, corresponding to the period of the aforementioned sampling phase. In synchronization with the selection signals, appropriate input current drive signals, constituting data signals, are applied to the column conductors 14 by the column driver circuit 18 as required for a row at a time addressing so as to set all the display elements in a selected row to their required drive level simultaneously in a row address period with a respective input signals determining the required display outputs from the display elements. Following addressing of a row in this way, the next row of display elements is addressed in like manner. After all rows of display elements have been addressed in a field period the address sequence is repeated in subsequent field periods with the drive current for a given display element, and hence the output, being set in the respective row address period and maintained for a field period until the row of display elements concerned is next addressed.

The matrix structure of the array, comprising the TFTs, the sets of address lines, the storage capacitors (if provided as discrete components), the display element electrodes and their interconnections, is formed using standard thin film processing technology similar to that used in active matrix LCDs which basically involves the deposition and patterning of various thin film layers of conductive, insulating and semiconductive materials on the surface of an insulating support such as glass or plastics material by CVD deposition and photolithographic patterning techniques. An example of such is described in the aforementioned EP-A-0717446. The TFTs may comprise amorphous silicon or polycrystalline silicon TFTs. The organic electroluminescent material layer of the display elements may be formed by vapor deposition or by another suitable known technique, such as spin coating.

The pixel circuit of FIG. 3 requires the use of both n and p channel transistors which can complicate the fabrication process. Moreover, this particular circuit requires four transistors and a common electrode whose provision may reduce the effective aperture of the pixel.

Figure 4:
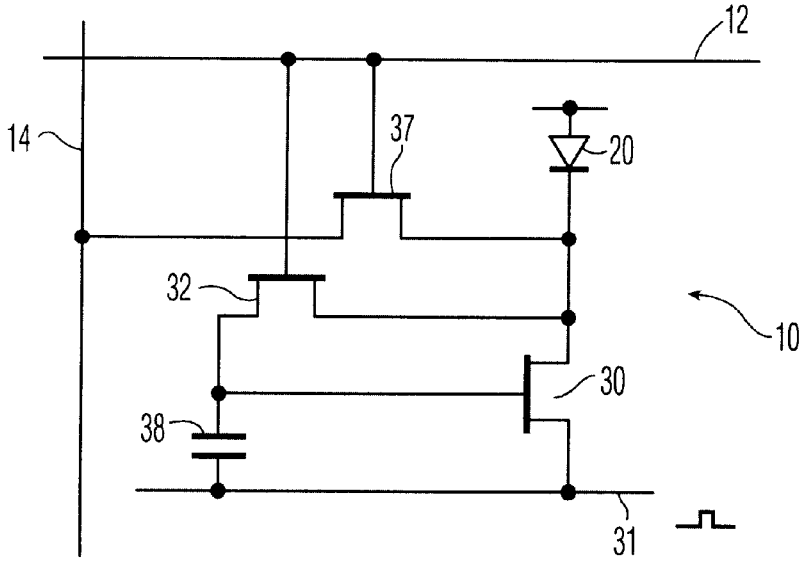
FIG. 4 shows a modified form of the pixel circuit.

FIG. 4 illustrates an alternative, modified, form of pixel circuit which avoids the need to use an opposite polarity type transistor. In this circuit the transistor 33 is removed and the input terminal 36 is connected directly to the display element 20. As with the previous circuit there are two phases, sampling and output, in the operation of the current mirror. During the sampling phase, the switching transistors 32 and 37 are closed, through a selection pulse on the associated row conductor 12, which diode-connects the transistor 30. At the same time the supply line 31 is supplied with a positive voltage pulse, rather than remaining at a constant reference potential as before, so that the display element 20 is reverse-biased. In this state, no current can flow through the display element 20 (ignoring small reverse leakage currents) and the drain current of the transistor 30 is equal to the input current lin. In this way, the appropriate gate-source voltage of the transistor 30 is again sampled on the capacitance 38. At the end of the sampling phase, the switching transistors 32 and 37 are turned off (opened) as before and the supply line 31 is returned to its normal level, typically OV. In the subsequent, output, phase, the transistor 30 operates as before as a current source drawing current through the display element at a level determined by the voltage stored on the capacitor 38.

In the embodiment of FIG. 4, a supply line 31 connected separately to a potential source may be provided for each row of pixels. During a sampling phase the display elements in the row being addressed are turned off (as a result of pulsing the supply line 31) and if there is effectively only one common supply line in the array which is common to all pixel circuits, i.e. the supply line 31 of one row is part of a continuous line interconnecting all rows of pixel circuits, then all the display elements would be turned off during each sampling phase irrespective of which row is being addressed. This would reduce the duty cycle (the ratio of ON to OFF times) for a display element. Thus, it may be desirable for the supply line 31 associated with a row to be kept separate from the supply lines associated with other rows.

Figure 5:
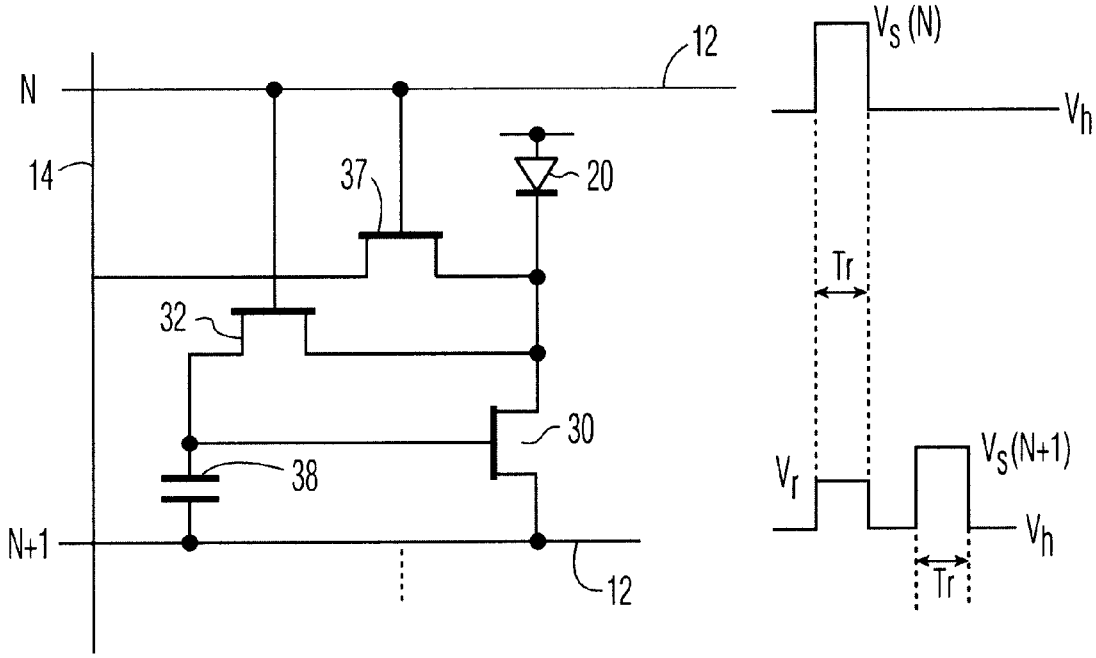
FIG. 5 shows another modified form of pixel circuit, together with associated drive waveforms for use therewith.

Another alternative form of pixel circuit which reduces the overall number of lines in the row direction is shown schematically in FIG. 5, together with typical drive waveforms employed in this embodiment. The pixel circuit depicted is one in the Nth row of the array and in this arrangement the source of the transistor 30 and the side of the capacitance 38 remote from the gate are both connected to the next, adjacent, row conductor 14 associated with the (N+1)th row of pixels rather than to a separate, dedicated, supply line 31. Operation of this pixel circuit is basically the same as previously described. The required row drive waveforms applied to the Nth and (N+1)th row conductors 12 (and all other row conductors) differ from those in the previous embodiments. In addition to comprising a low, hold, level $V_h$ which holds the transistors 32 and 37 of the pixel circuits connected thereto in their off (open) state and a selection (gating) pulse $V_s$ which turns those transistors on (closed) and defines a respective row address period (sampling phase), Tr, the waveform applied to each row conductor further includes an intermediate level pulse arranged to reverse bias the display element in similar manner to the pulsing of the supply line 31 in the FIG. 4 embodiment. In FIG. 5, $V_s$(N) denotes the selection pulse applied to the Nth row conductor to operate the transistors 32 and 37 of the pixel circuits in that row and $V_s$(N+1) denotes the selection signal applied to the next, (N+1)th row conductor which, because the rows are addressed in sequence, occurs after the signal $V_s$(N). The waveform for each row conductor includes a positive pulse, Vr, which precedes the selection signal and is coincident in time with the selection signal applied to the preceding row conductor 12 so that when the pixel circuits in the preceding row, i.e. the Nth row, are addressed upon the application thereto of $V_s$(N) the positive pulse Vr appearing on the (N+1)th row conductor serves to reverse bias the display elements in the pixel circuits in row N during their sampling phase. The level of Vr is selected so as to provide the desired reverse biasing while being lower than the selection signal $V_s$ so as to ensure that the transistors 32 of 37 and the pixels circuits in the next, (N+1)th row are not turned on.

With regard to all the above-described embodiments, it will be appreciated that although the pixel circuits are based on an n-channel transistor 30, the same modes of operation are possible if the polarity of these transistors is reversed, the display element polarity is reversed, and the polarity of the pulses applied to the supply lines 31 row conductors 12 when used are reversed. Where p-type transistors 33 are used, these would become n-type.

There may be technological reasons for preferring one or other orientation of the diode display elements so that a display device using p-channel transistors is desirable. For example, the material required for the cathode of a display element using organic electroluminescent material would normally have a low work function and typically would comprise a magnesium-based alloy or calcium. Such materials tend to be difficult to pattern photolithographically and hence a continuous layer of such material common to all display elements in the array may be preferred.

It is envisaged that instead of using thin film technology to form the TFTs and capacitors on an insulating substrate, the active matrix circuitry could be fabricated using IC technology on a semiconductor, for example, silicon, substrate. The upper electrodes of the LED display elements provided on this substrate would then be formed of transparent conductive material, e.g. ITO, with the light output of the elements being viewed through these upper electrodes.

It is envisaged also that the switches 32, 33 and 37 need not comprise transistors but may comprise other types of switches, for example, micro-relays or micro-switches.

Although the above embodiments have been described with reference to organic electroluminescent display elements in particular, it will be appreciated that other kinds of electroluminescent display elements comprising electroluminescent material through which current is passed to generate light output may be used instead.

The display device may be a monochrome or multi-color display device. It will be appreciated that a color display device may be provided by using different light color emitting display elements in the array. The different color emitting display elements may typically be provided in a regular, repeating pattern of, for example, red, green and blue color light emitting display elements.

In summary, an active matrix electroluminescent display device has an array of current-driven electroluminescent display elements, for example comprising organic electroluminescent material, whose operations are each controlled by an associated switching means to which a drive signal for determining a desired light output is supplied in a respective address period and which is arranged to drive the display element according to the drive signal following the address period. Each switching means comprises a current mirror circuit in which the same transistor is used to both sense and produce the required drive current for the display element with the gate of the transistor being connected to a storage capacitance on which a voltage determined by the drive signal is stored. This allows variations in transistor characteristics over the array to be compensated and improved uniformity of light outputs from the display elements to be obtained.

From reading the present disclosure, other modifications will be apparent to persons skilled in the art. Such modifications may involve other features which are already known in the field of matrix electroluminescent displays and component parts thereof and which may be used instead of or in addition to features already described herein.

What is claimed is:

1. An active matrix electroluminescent display device comprising a matrix array of electroluminescent display elements each of which has an associated switching means for controlling the current through the display element in accordance with an applied drive signal and in which the switching means comprises a drive transistor whose first current-carrying terminal is connected to a first supply line, whose second current-carrying terminal is connected via the display element to a second supply line and whose gate is connected to its first current-carrying terminal via a capacitance, wherein the second current-carrying terminal of the drive transistor is connected to an input terminal for the drive signal and wherein a switch device is connected in series between the second current-carrying terminal and the gate of the transistor which is operable during the application of a drive signal so as to store a gate voltage on the capacitance determined by the drive signal.

2. An active matrix electroluminescent display device according to claim 1, wherein the display elements are arranged in rows and columns, and the switch devices of the switching means for a row of display elements are connected to a respective, common, row address conductor via which a selection signal for operating the switch devices in that row is supplied, and each row address conductor is arranged to receive a selection signal in turn, whereby the rows of display elements are addressed one at a time in sequence.

3. An active matrix electroluminescent display device according to claim 2, wherein the drive signals for the display elements in a column are supplied via a respective column address conductor common to the display elements in the column, there being a further switch device connected between the input terminal of the switching means of a display element and its associated column address conductor which is operable to transfer a drive signal on the column address conductor to the input terminal when the first mentioned switch device is closed.

4. An active matrix electroluminescent display device according to claim 3, wherein the further switch device is connected to the same row address conductor as the first-mentioned switch device and operable simultaneously with that switch device by a selection signal applied to the row address conductor.

5. An active matrix electroluminescent display device according to any one of claim 2, wherein the first supply line is shared by all the display elements in the same row or column with a respective supply line being provided for each row or column of display elements.

6. An active matrix electroluminescent display device according to claim 5, wherein the first supply line is associated with, and shared by, a row of display elements and comprises the row address conductor associated with a different row of display elements via which a selection signal is applied to the switch devices of the switching means of that different row.

7. An active matrix electroluminescent display device according to claim 1, wherein a switch device is connected between the second current-carrying terminal of the drive transistor and the display element which is operable to isolate the display element from the drive transistor when the switch device connected between that terminal and the gate of the drive transistor is closed.

8. An active matrix electroluminescent display device according to claim 1, wherein the first supply line is arranged to receive a pulse signal during the application of a drive signal such as to reverse bias the display element.

9. An active matrix electroluminescent display device according to claim 1, wherein drive transistors and the switch devices comprise thin film transistors carried on an insulating substrate.

* * * * *